US006446847B1

(12) United States Patent
Huffer

(10) Patent No.: US 6,446,847 B1
(45) Date of Patent: Sep. 10, 2002

(54) FLEXIBLE CONTAINER HAVING INTEGRALLY FORMED RESEALABLE SPOUT

(75) Inventor: Scott W. Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/784,862

(22) Filed: Feb. 16, 2001

(51) Int. Cl.[7] ..... B65D 47/10
(52) U.S. Cl. ..... 222/541.9; 222/572; 383/211
(58) Field of Search ..... 222/541.9, 572; 383/211

(56) References Cited

U.S. PATENT DOCUMENTS

| | | | | |
|---|---|---|---|---|
| 2,012,275 A | | 8/1935 | Hescher | 150/3 |
| 2,665,033 A | | 1/1954 | Robertson | 222/107 |
| 3,137,419 A | | 6/1964 | Davy | 222/527 |
| 3,181,439 A | | 5/1965 | Flax | 93/35 |
| 3,815,794 A | | 6/1974 | Carlisle | 222/491 |
| 3,917,116 A | * | 11/1975 | Mason | 383/211 |
| 4,163,509 A | | 8/1979 | Amneus | 222/95 |
| 4,301,926 A | | 11/1981 | Chung | 206/620 |
| 4,411,359 A | | 10/1983 | Franco | 206/217 |
| 4,640,425 A | | 2/1987 | Cabernoch | 215/11 E |
| 4,704,314 A | * | 11/1987 | Hsu et al. | 383/211 |
| 4,717,046 A | | 1/1988 | Brogli | 222/107 |
| 4,830,205 A | | 5/1989 | Hammond et al. | 215/11.3 |
| 4,875,587 A | * | 10/1989 | Lulham et al. | 383/211 |
| 4,881,649 A | * | 11/1989 | Hsu et al. | 383/211 |
| 4,978,232 A | | 12/1990 | Dunton | 383/33 |
| 5,000,350 A | | 3/1991 | Thomsen | 222/103 |
| 5,228,782 A | | 7/1993 | Imer | 383/200 |
| 5,251,982 A | | 10/1993 | Stenstrom et al. | 383/209 |
| D346,549 S | | 5/1994 | Smith | D9/302 |
| 5,312,189 A | | 5/1994 | Aeschbach et al. | 383/207 |
| 5,378,065 A | | 1/1995 | Tobolka | 383/9 |
| 5,411,178 A | | 5/1995 | Roders et al. | 222/105 |
| 5,529,224 A | | 6/1996 | Chan et al. | 222/212 |
| 5,531,358 A | | 7/1996 | Corella | 222/107 |
| 5,800,062 A | | 9/1998 | Tobolka | 383/104 |
| 5,863,131 A | | 1/1999 | Nakamura | 383/89 |
| 6,149,304 A | * | 11/2000 | Hamiton et al. | 383/211 |

FOREIGN PATENT DOCUMENTS

| | | |
|---|---|---|
| EP | 0 300 094 | 12/1987 |

* cited by examiner

*Primary Examiner*—Philippe Derakshani
(74) *Attorney, Agent, or Firm*—Drinker Biddle & Reath LLP

(57) ABSTRACT

A flexible container for dispensing liquids is disclosed. The flexible container includes a spout which is integrally formed with a reservoir body of the container. The integral spout includes a cohesive material disposed across the spout opening for providing easy access to the reservoir and which then may be resealed.

22 Claims, 2 Drawing Sheets

FLEXIBLE CONTAINER HAVING INTEGRALLY FORMED RESEALABLE SPOUT

FIELD OF THE INVENTION

The present invention relates to a flexible container for dispensing liquids. The flexible container includes a resealable spout disposed to allow liquid to be withdrawn.

BACKGROUND OF THE INVENTION

It is popular to package ingestable liquids in flexible containers made from a variety of materials. Such flexible containers are capable of being packaged with a separate straw for withdrawing liquid from the container. However, packaging a straw together with a flexible container is costly, inefficient, and often ineffective in that an extra packaging step is required and the straw is prone to coming dislodged from the container prior to use.

In order to alleviate such problems, containers have been developed which incorporate a withdrawal means which is integral with the container itself. For instance, U.S. Pat. No. 4,411,359 to Franco describes a flexible pouch formed from two laminated sheets heat-sealed together and having an extensible straw mounted inside the pouch, held in place by a mounting flange which is secured to the perimeter seals of the pouch. The flange retains the straw in alignment with an openable edge of the pouch. The edge is opened by peeling apart the two sheets, providing access to the straw. The pouch is not resealable and cannot be re-closed in order to facilitate partial withdrawal of the contents.

U.S. Pat. No. 5,251,982 to Stenstrom et al. shows a flexible pouch having a corner thereof which forms a dispensing tube. The dispensing tube is opened by gripping a pair of free flaps at the end thereof. The weld which forms the end of the tube is identified as being peelable. The tube is not resealable nor otherwise capable of being closed once the original seal is broken.

SUMMARY OF THE INVENTION

The present invention includes a flexible container or pouch having a body portion that forms a flexible fluid reservoir and an integrally formed spout capable of being easily resealed after its initial use. The spout is made resealable, preferably, by an adhesive found on the interior surfaces of the spout opening.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
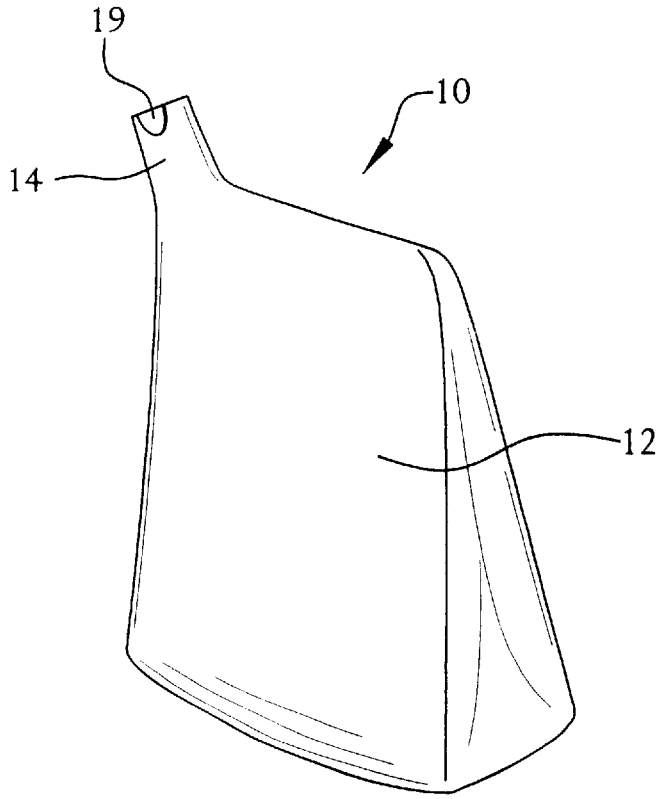
FIG. 1 is a isometric view of a flexible container according to the present invention.

Referring now to the figures wherein like reference numerals identify corresponding or similar elements throughout the several views, there is shown a flexible container which is indicated generally by the reference numeral 10. As illustrated in FIG. 1, the flexible container 10 comprises a reservoir body 12 and a spout 14 which is integrally formed with the body 12.

The container 10 comprises at least one sheet joined and sealed together at its side edges. In one embodiment, the container 10 comprises a gusseted bottom (not shown) and separate front and back side walls. The side walls extend upwardly so as to form the spout 14. The edges of the side walls may be heat sealed together. The spout 14 may also be formed by a side edge heat seal so as to form a single discharge opening 18.

Figure 2A:
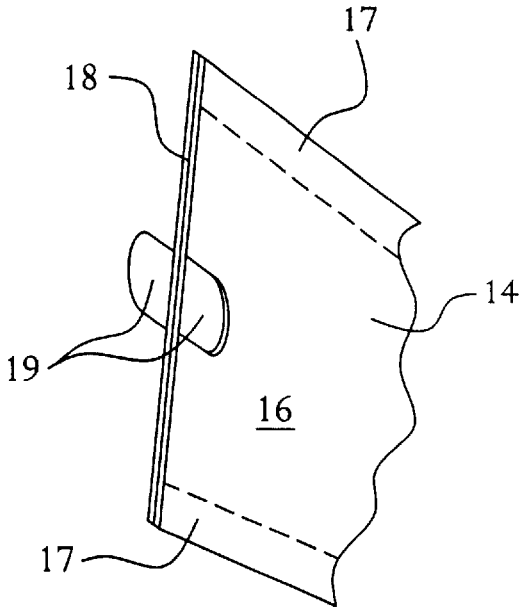
FIG. 2A is an enlarged view of a spout portion of the present invention.
Figure 2B:
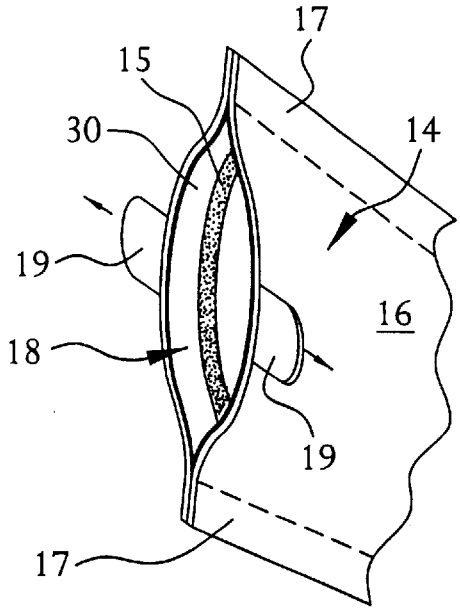
FIG. 2B is an enlarged view of the spout portion in its open position.
Figure 2C:
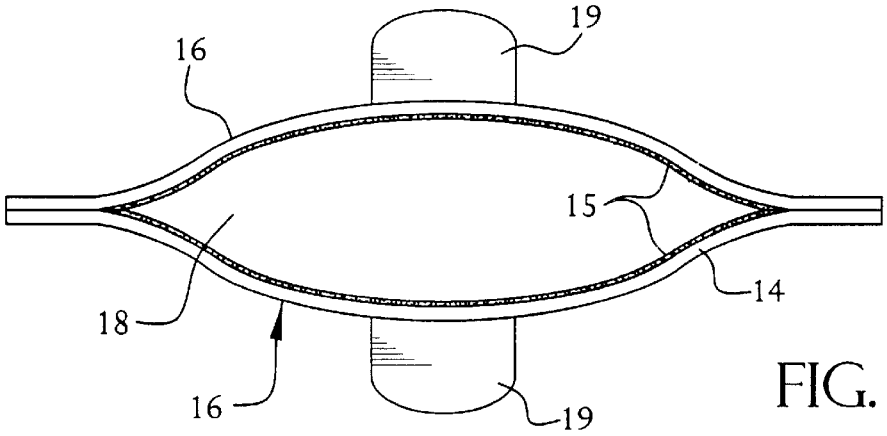
FIG. 2C is a top plan view of an opened spout portion according to the present invention.
Figure 3:
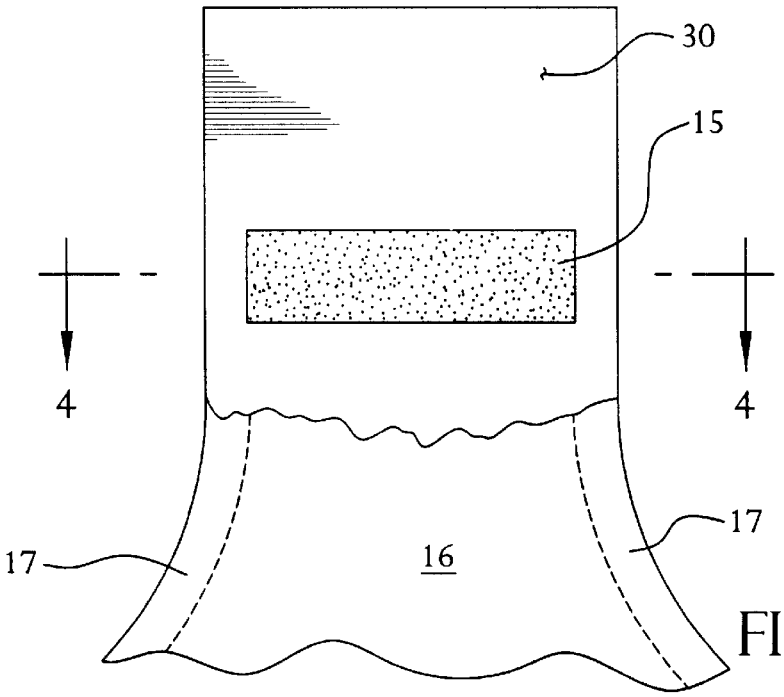
FIG. 3 is an enlarged view of the spout with a portion of one side wall removed.

As illustrated in FIGS. 2A, 2B and 2C, and also in part in FIG. 3, at the discharge opening 18, located at the spout 14, a cold seal cohesive 15 is applied on the interior surfaces 30 of the side walls 16. When the spout is in its closed position, as shown in FIG. 2A, the cold seal cohesive 15 (FIG. 2B) on the interior surfaces 30 of the two side walls 16 come into contact with each other so as to seal the spout 14. The cohesive seal acts to prevent liquid from getting out of the reservoir body 12 within the container 10.

The cold seal cohesive 15 preferably comprises a latex having other synthetic or natural rubber components or acrylic components. Therefore, the cohesive comprises a water based emulsion having rubber polymers and acrylic polymers. In the preferred embodiment, the ratio of rubber polymers and acrylic polymers is approximately 80% rubber to 20% acrylic. When utilizing natural rubber, a smaller percentage of rubber is desired so as to reduce the potential for allergic reactions.

Preferably, the emulsion is applied to the interior facing surface 30 by printing, such as by a rotogravure or flexographic process. As seen in FIG. 3, the cohesive 15 is applied in the form of a band or strip along the interior facing surfaces 30 of the side walls 16 at the spout 14. The amount of cohesive 15 to be used is functionally related to the size and shape of the spout 14, the volume of liquid to be retained in the reservoir, etc., and will vary accordingly.

A pair of tabs 19 are provided at the projected end of the spout 14 to facilitate opening. When desired, a consumer will grasp the tabs and pull apart the facing sheets 16 (as shown in FIG. 2B) to create the discharge opening 18. Thus, access to the liquid in the reservoir body is obtained without the use of a separate withdrawal means such as a straw or cutting device. Once the spout 14 is open, liquid may be withdrawn by sucking on the spout 14 or by applying a slight hand pressure to the body 12. The spout 14 is closed by pushing the pair of cooperating sheets 16 that form the spout 14 together so as to engage their respective cohesive areas 15. Once closed, the spout 14 acts to effectively prevent liquid from exiting the container 10.

As an alternative to the cold seal cohesive, a pressure sensitive adhesive may be used. For food or medical applications, it is important that the selection of cohesive or pressure sensitive adhesive be in compliance with the Food and Drug Administration's direct food contact requirements. Also, a peelable heat seal may be applied above the cohesive or adhesive at the end of the spout. To withdraw liquid, the spout 14 is opened by pulling the sheets 16 apart, using the tabs 19, thereby breaking the peelable heat seal and exposing the cohesive, which is also separated. To close the container 10 after a portion of the liquid has been withdrawn, the spout 14 is pushed together so as to cause the cohesive located on the interior facing surfaces 30 of each side wall sheet 16 to engage each other and reseal. As an alternative, the resealable closure disclosed in U.S. Pat. No. 6,076,969, the specification of which is hereby incorporated by reference, may be utilized on the spout to form the resealable closure.

Figure 4:
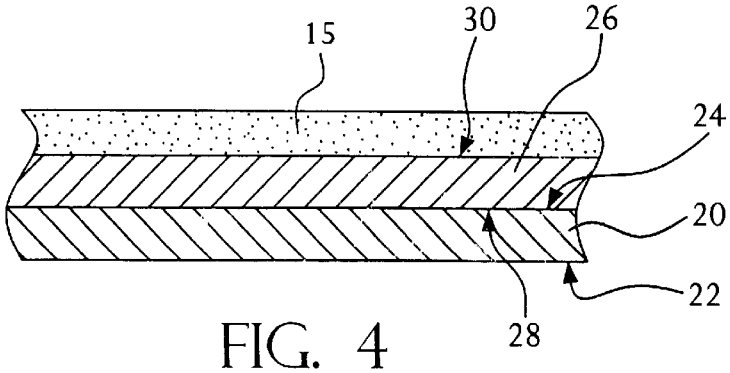
FIG. 4 is a cross-sectional view taken along the line 4—4 of FIG. 3 showing an embodiment of the wall of the spout.

Preferably, the material that forms the bottom wall and side walls of the container 10 comprises two plies as us shown in FIG. 4. An outer ply 20 includes an exterior surface 22 and an interior surface 24. A second or interior ply 26 includes a first surface 28 facing the interior surface 24 of the outer ply 20 and a second interior facing surface 30. The interior surface 24 of the outer ply 22 and the first surface 28 of the second ply 26 are preferably permanently adhered to one another over a major portion thereof.

The outer ply 20 may be made from an oriented polypropylene, polyester or other clear polymer. The second ply may be made of a clear, white or metallized polyethylene or cast polypropylene film. The second ply 26 is preferably a white polyethylene film which is capable of being heat sealable. The second ply 26 must also be compatible with a cohesive and suitable for handling ingestable liquids. To increase the stiffness of the container 10, either the outerply 20 or the second ply 26 (or both) may comprise high density polyethylene. Alternatively, a metallic film or aluminum foil can be situated between the outer ply and the second ply.

Although the invention has been described and illustrated with respect to the exemplary embodiments thereof, it should be understood by those skilled in the art that the foregoing and various other changes, omissions, and additions may be made therein and thereto, without departing from the spirit and scope of the present invention.

What is claimed is:

1. A container comprising:

a body made from a flexible sheet material, the sheet material defining opposing side walls, the side walls sealed together around the peripheral edges and forming a reservoir for a fluid, and a spout integrally formed with said body and extending through one sealed edge, the spout providing access to the reservoir, the spout having an opening at the projected end, opposite the reservoir, for dispensing fluid from the reservoir, and a resealable seal formed adjacent the projected opening for selectively closing the opening the spout.

2. A container according to claim 1, wherein the body further comprises a bottom wall sealed at its peripheral edges to at least one edge of the side walls, said side walls extending upward from the bottom wall, with the spout formed in the upper edge of the sidewalls, opposite the bottom wall.

3. A container according to claim 1, wherein the side edges of the side walls are heat sealed together so as to form the reservoir, and the spout is defined as a passageway through the heat seal along one side edge.

4. A container according to claim 1, wherein the resealable seal formed across the spout comprises a cold seal cohesive.

5. A container according to claim 4, wherein the spout further comprises a peelable heat seal for initially sealing the opening.

6. A container according to claim 4, wherein the cold seal cohesive is a latex comprising rubber components and acrylic components.

7. A container according to claim 6, wherein the rubber components comprise natural rubber.

8. A container according to claim 6, wherein the rubber components comprise synthetic rubber.

9. A container according to claim 6, wherein the latex comprises approximately 80% rubber components and 20% acrylic components.

10. A container according to claim 1, wherein the spout further comprises a set of tabs on opposite sides thereof for gripping while opening the spout seal.

11. A container according to claim 1, wherein the body and spout are formed from a sheet material comprising a clear outer ply having an exterior surface and an interior surface; and a second ply including a first surface facing the interior of said outer ply and a second interior facing surface, the interior surface of said outer ply and the first surface of said second ply being permanently adhered to one another over a major portion of their extent.

12. A container according to claim 11, wherein the clear outer ply is made of oriented polypropylene.

13. A container according to claim 11, wherein the second ply is made of white polyethylene.

14. A container according to claim 11, wherein the second ply is made of clear polyethylene.

15. A container according to claim 11, wherein the second ply is made of metallized polyethylene.

16. A container according to claim 11, wherein the second ply is made of metallized cast polypropylene.

17. A flexible container according to claim 10, wherein the at least one sheet comprises high density polyethylene.

18. A flexible container according to claim 11, wherein the sheet material further comprises a metallic film disposed between the outer ply and the second ply.

19. A flexible container according to claim 11, wherein the resealable spout comprises a set of tabs formed on opposite sides of the spout opening for gripping and opening the sealed spout.

20. A container comprising:

a body formed from at least one sheet of a flexible sheet material, the sheet material forming opposing side walls, the side walls sealed together around one or more peripheral edges, the side walls and edge seals defining a reservoir, a spout integrally formed with the sheet material of the body, the spout defining a passageway extending through one of the edge seals and in communication with the reservoir, the sprout adapted for dispensing the material contained within the reservoir, and the spout having a resealable adhesive provided across the passageway, the adhesive selectively sealing the passageway to control access to the reservoir.

21. A container according to claim 20 wherein the body and spout are formed from a sheet material comprising a clear outer ply having an exterior surface and an interior surface; and a second ply including a first surface facing the interior of said outer ply and a second interior facing surface.

22. A container according to claim 20, wherein the spout includes a set of integrally formed tabs projecting from the end of the passageway, the tabs provided for separating the sidewalls of the passageway and releasing the resealable adhesive.

* * * * *